United States Patent [19]

Staijen et al.

[11] Patent Number: 5,074,835

[45] Date of Patent: Dec. 24, 1991

[54] DEVICE FOR STACKING AND CUTTING A ZIGZAG FOLDED WEB

[75] Inventors: Theodoris J. E. Staijen, Apeldoorn; Adelbert Schoonman, Brummen; Pieter Brasser, Dieren, all of Netherlands

[73] Assignee: B.V. Machinefabriek H.H. Drent, Eerbeck, Netherlands

[21] Appl. No.: 518,157

[22] Filed: May 3, 1990

[30] Foreign Application Priority Data

May 22, 1989 [NL] Netherlands ..... 8901275

[51] Int. Cl.[5] ..... B65H 35/00

[52] U.S. Cl. ..... 493/357

[58] Field of Search ..... 493/351, 372, 359, 411–414, 493/417, 410, 356, 357; 270/30, 39, 40, 52.5; 225/93, 103, 104; 83/89, 90, 91

[56] References Cited

U.S. PATENT DOCUMENTS

| | | | |
|---|---|---|---|
| 4,650,447 | 3/1987 | Meschi | 493/412 |
| 4,788,165 | 10/1988 | Buck . | |
| 4,842,572 | 6/1989 | Roth | 493/357 |
| 4,908,010 | 3/1990 | Yoshioka | 225/103 |

FOREIGN PATENT DOCUMENTS

| | | |
|---|---|---|
| 0190749A3 | 8/1986 | European Pat. Off. . |
| 0244003 | 7/1987 | European Pat. Off. . |
| 8509218.5 | 9/1985 | Fed. Rep. of Germany . |
| 359721 | 3/1962 | Switzerland . |
| 2177070A | 1/1987 | United Kingdom . |
| 2196944A | 11/1988 | United Kingdom . |

*Primary Examiner*—D. S. Meislin
*Assistant Examiner*—Jack Lavinder
*Attorney, Agent, or Firm*—Joseph P. Calabrese

[57] ABSTRACT

A combination is provided including a conveyor for bringing a zigzag folded web of forms to a fold-cutting device. The device comprises a table movable in the vertical plane, vertical confining walls for the form stack, a unit-opening finger supported such that it can be brought partly into the form stack to lift the upper forms so that a slit is formed. A flexible plate extends and moves in the horizontal plane so that it can be brought into the formed slit. A knife plate positioned below the flexible plate is movable together with the flexible plate. A cutting edge of the knife plate is positioned at some distance behind the leading edge of the flexible plate until the flexible plate is moved adjacent the fold to be cut and there is brought to a stop, after which the knife plate can be moved an additional distance for cutting of the fold.

2 Claims, 1 Drawing Sheet

DEVICE FOR STACKING AND CUTTING A ZIGZAG FOLDED WEB

BACKGROUND OF THE INVENTION

1. Field of the Invention

The invention relates to apparatus for processing a zigzag folded web of forms into a stack whereat superposed forms are vertically aligned and cut at a given stack location for removal of a stack unit or section. The provided apparatus comprises a table movable in the vertical plane and positioned near the end of a feed conveyor. Vertical confining walls assist in forming forms of said web fed onto said table into a desired vertical stack, and a knife movable substantially in a horizontal plane transversely to the stack cuts a fold between two contiguous forms when a vertical stack is formed on the table.

2. Description of the Prior Art

Such type of apparatus is known from EP-A-O 244 003. In the latter device it is necessary that a knife having a sharp cutting edge be able to penetrate into a form stack to cut off the fold positioned at the far side of the stack or pile. A fold, however, will never define a true straight line. The latter is particularly true when thin papers are used in the formation of the zigzag forms. Also, a form will not lie exactly in one plane. This results in the danger that when the knife is urged into the pile it will not lie exactly between two forms or sheets, but it will also lie partly against folds present between the sheets which lie below and above such sheets. In consequence, desired separation of a shaped form unit on the table from the successive web forms will not take place and interruptions in the working of the apparatus will occur.

Further it should be noted that in U.S. Pat. No. 4,508,527 apparatus is described for bringing a zigzag folded web of forms into the shape of a pile including a horizontally movable knife plate for cutting off the web. To arrange the sheets into a stack or pile, the folds of the pile are guided by spiral rotors rotating around vertical axes. Also, the knife plate is divided into two sections comprising a first section provided with the cutting edge and which is brought into the pile at a high speed and a second section which is moved with a lower speed and will join said first section afterwards.

Such a device will only be suitable for use with a web of forms made paper having a certain stiffness because otherwise the danger is present that the first section of the knife which is moving at a high speed, will come into contact with the web of forms at a wrong location so as to result in form damage and/or work stoppage.

The object of the provided invention is to remove the above-mentioned disadvantages of the prior art. To that end there is provided an apparatus comprising at least one stack-opening finger together with support means for such finger so that it can be moved from a position outside the pile or stack of forms to a position in which it is positioned partly in said pile. The provided finger lifts the stack forms lying above it for forming a slit or opening. A flexible plate is also provided extending substantially in the horizontal plane in association with means for supporting this plate such that it can be moved in the horizontal plane into the knife-formed slit. An adjacent knife plate is positioned below the flexible plate and support means for the knife plate to enable the latter to move with the flexible plate. The cutting edge of the knife plate is positioned at some distance behind the leading edge of said flexible plate until the flexible plate is positioned under substantially the total unit and close to the fold to be cut, and there is brought to a stop. The knife plate is then moved beyond the flexible plate leading edge for cutting the fold.

Thus the apparatus finger first forms a slit between two succeeding forms or a formed stack after which the flexible plate is moved into the slit. The knife plate is positioned below the flexible plate as the flexible plate supports that portion of the web of forms located above it. Thus this stack portion cannot come into contact with the knife plate. As a result, the knife plate only functions for cutting a stack fold and there is no danger that the knife plate will engage other portions of the web forms defining the stack.

In the provided apparatus, the support means for the slit-forming finger may comprise a shaft connected to the finger which in the inoperative position of the finger is substantially vertically disposed. The shaft is associated with means for rotating said shaft to bring said finger into the pile. A support plate is provided on which said shaft is mounted together with means for supporting said support plate in such manner that after the finger is brought into the pile said finger will move substantially in the vertical direction.

The provided finger of the apparatus is able to pivot into the stack of forms in substantially the horizontal plane, and then move upwardly to form the desired slit in the form stack or pile. By pivoting the finger horizontally into the pile, damage of sheets between which the finger has been inserted, will be prevented. Obviously the leading edge of the finger which first contacts the form stack should be thin so that it can penetrate between two succeeding or contiguous sheets.

In addition, hold down means may be present in the provided apparatus which can be brought into the slit formed by the pile-opening finger. The hold down means is adapted to press the pile portion lying below the slit-forming finger downwardly over a given length of the sheets forming the stack.

Because the hold down means need only be brought inwardly into the pile a short distance, the slit made by means of the opening finger will normally be large enough to provide entry of the hold down means. In view of the fact that the flexible plate together with the knife plate can move adjacent to and over the hold down means after the latter is pressed onto the pile, a reliable operation of the provided apparatus is assured. Also, when using thin paper in the formation of the web forms, the flexible plate can be moved into the stack slit when it is horizontally actuated and it will not engage a fold of the form web directed towards or facing the plate.

In practice it has been found that the parts of the web of forms coming to rest on the apparatus table in most cases will not lie flat on the table. When the web of forms is supplied to the device by means of a conveyor belt running at an incline, and this is indicated in the above mentioned European patent application, the edges where the folds are present will lie higher than the middle portion of the related sheet.

To prevent difficulties resulting from such initial non-planar condition in accordance with this invention there is provided in the table at least one strip running parallel to the opposed folds of the web of forms. Such strip during the supplying of the web of forms to the table is positioned at some distance above the upper surface of the table from which it is formed.

Before a fold is cut off for forming a form unit by moving the flexible plate and the knife plate into the slit, as above described, such table strip will be brought downward into a table-receiving recess, simultaneously performing a sheet-aligning function as will hereinafter be described. The table strip will enable the sheets of the web of forms to assume a substantially flat position so that disturbances in the operation of the device will be prevented.

The provided apparatus also includes means for vibrating the stack-supporting table for assisting in desired positioning of the web of forms on the table as will also hereinafter be described in greater detail.

In accordance with a preferred embodiment of the apparatus of this invention one of the vertical walls adjacent the table is divided into an upper and a lower section defining a slot through which the stack-opening finger, the hold down means, the flexible plate and the knife plate may enter the stack of forms.

In the provided apparatus, the second vertical wall, lying opposite the divided wall, can be positioned such that this can be brought into vibration or into a reciprocating movement. It has been found that such movements assist in the formation of a form stack in which the folds will lie exactly above each other in vertical alignment. By such alignment, the dimensions of the pile will be exactly fixed resulting in ease of packaging of the stack segments or units formed by the provided apparatus.

According to a further embodiment of the invention, a conveyor belt can be provided near the upper rim of the second vertical wall, which belt runs substantially horizontally and joins the form feed conveyor whereby the web of forms is supplied to the provided apparatus.

The provided conveyor belt enables the fed forms to be in the same position when they are deposited on the forms which are already present on the table of the apparatus. Thus, the influence of the angle between the supply conveyor and the horizontal plane is eliminated in this way.

Known means can be present in the provided apparatus to bring the table on which a unit is present after formation by cutting off a fold, downwardly, to remove the severed stack unit from the table, and thereafter to return the table upwardly to its initial position.

There may also be provided in the apparatus a wall which is divided into two sections, and support means for the stack-opening finger and the hold-down means. The operating means for these are provided on a support construction which is movable in substantially the horizontal plane relative to said second vertical wall and in addition may be locked in certain positions. The provided apparatus is thus rendered suitable for use with sheets of various dimensions and which constitute the web of forms.

The flexibility of the provided apparatus is also assisted by replacing the table onto which the pile is deposited by another of corresponding size when the sheet size is changed. It is, however, possible that the table may comprise segments which are slidably movable relative to each other so as to form varying surface areas of desired dimensions.

DESCRIPTION OF THE DRAWINGS

The invention is further described with reference to an embodiment, shown in the drawing, in which.

Figure 1:
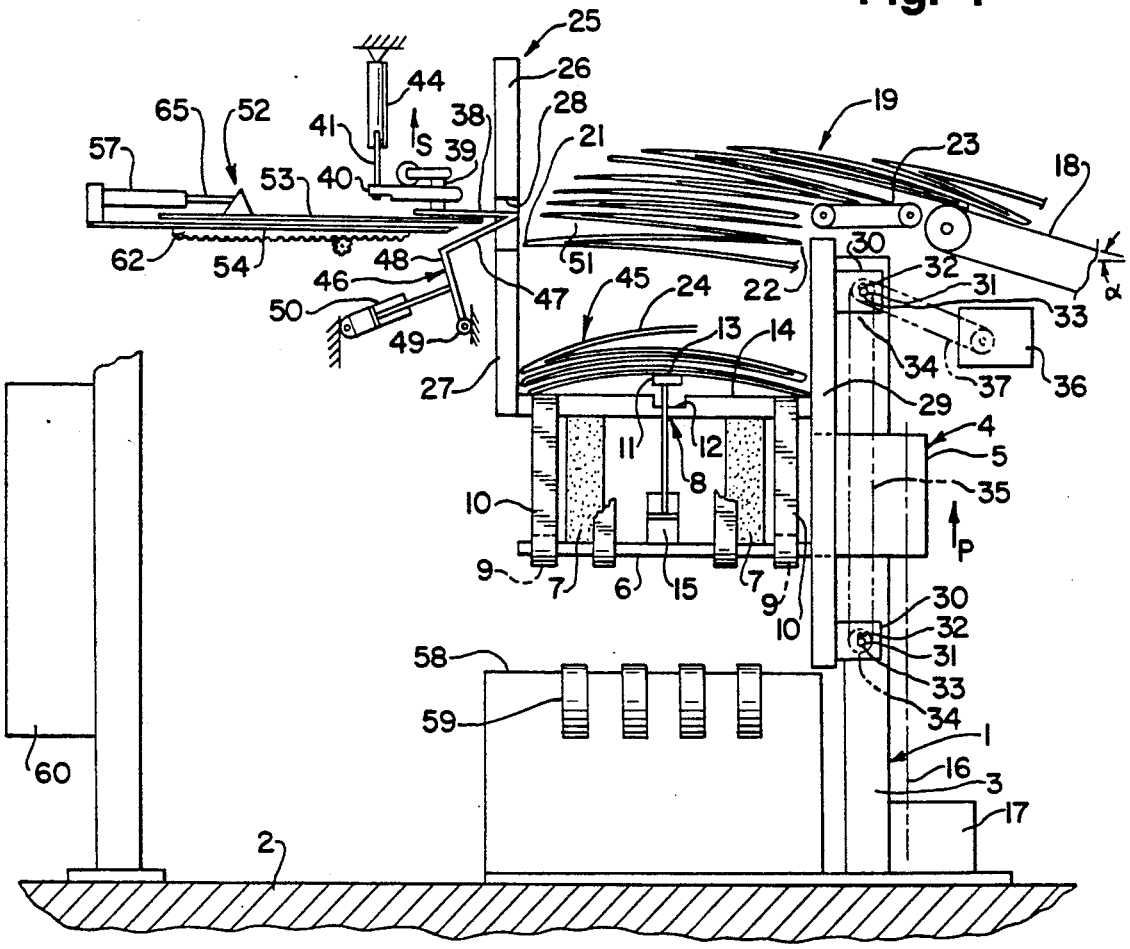
FIG. 1 schematically shows a side view of a device according to the invention.

The device, schematically shown in the drawing, comprises a frame 1 which may be supported on floor 2 as illustrated. The frame 1 comprises a column 3 for guiding a table 4 in the vertical direction. The table comprises: a guiding portion 5 which in the direction of the arrow P is slidable along the column 3; a lower frame 6 on which vibration magnets 7 are provided and an upper plate 8 connected to the vibration magnets 7. Rollers 9 are mounted on the lower frame 6 and the upper plate 8 respectively. Conveyor belts 10 extend around the assembly of lower frame and upper plate and run over the rollers 9 and have approximately the width of the rollers 9. At least one strip 11 can be received in a cavity 12 in the upper plate 8 such that strip upper surface 13 can be flush with upper surface 14 of the upper plate 8 when the strip is retracted. The rod of a cylinder 15 containing a pressurized medium serves to move the strip upwardly towards the position indicated in FIG. 1.

The rollers 9 about which the conveyor belts 10 move are in line with each other and can be mounted on a common shaft which may be rotated by means of a motor (not illustrated).

To move the table 4 in the direction of the arrow P, use can be made of a vertical actuating mechanism 16 (such as a worm gear schematically illustrated in phantom line) traversing a guiding portion 5 of the table 4. The actuating mechanism 16 can be driven by means of motor-gear assembly 17.

When placing the device into operation the table 4 will be in the highest position and the strip 11 of plate 8 will extend above the upper surface 14 of the upper plate and be in the position indicated in FIG. 1. In such apparatus position, supply conveyor 18 feeds a zigzag folded web of forms 19 to the left as seen in FIG. 1. The web of forms comprises the sheets 20. Each sheet is connected to a succeeding sheet by means of a fold 21 and to a preceding sheet by means of a fold 22. Although the drawing illustrates the sheets spaced some distance from each other to facilitate description, in reality the sheets will lie closely on each other.

From the supply conveyor 18 the web of forms 19 is conveyed onto a short horizontal conveyor belt 23 which is driven in a conventional manner. Thus, the angle between the supply conveyor 18 and the horizontal, will have no influence on the feeding of the web of forms 19 onto the table 4.

From the conveyor belt 23 the web of forms 19 is brought onto the table 4 on which the sheets 20 of the web leaving the conveyor belt 23 will be substantially in the horizontal plane because the table 4 is gradually moved downwardly in accordance with the height of the folded web of forms 19.

For forming a precise vertical form pile 24, i.e., a pile in which the folds 21 and 22 will lie exactly above each other, use is made of a first vertical wall 25 comprising an upper section 26 and a lower section 27 having a slot 28 therebetween. Wall 25 is employed in conjunction with a second vertical wall 29 against which the folds 22 abut.

The vertical wall 29 is provided with spaced housings 30 near the upper and the lower wall ends which have circular openings 31 in which eccentrically mounted rolls 32 are rotatably positioned. The two rolls 32 near the lower end of the wall are provided on an eccentrically positioned, common shaft 33, as well as are the two rolls 32 near the upper end of the wall 29. The two shafts 33 are provided with sprockets 34 engaging a chain 35 serving to couple the shafts 33. A chain drive 37 (not shown in detail), and a motor 36 rotatably drive one of the shafts 33.

The foregoing sprocket and chain assembly imparts a somewhat elliptical movement to the vertical wall 29. This movement will be such that when the wall 29 is moving towards the table 4, it is simultaneously moving downwardly to urge the folds 22 into alignment on the table 4. To this end the surface of the wall 29 facing the web of sheets can be treated in a given way, e.g. can be roughened for obtaining the desired web-aligning effect.

As described above, during the forming of a pile 24 on the table 4, the upper plate 8 of the table 4 will be vibrated by means of a vibration magnets 7 known in the art supporting the upper plate 8, in respect of the lower frame 6.

After a given number of sheets 20 has been received on the upper plate 8 and after a pile 24 is shaped, this pile is separated from the succeeding sheets of a desired form unit by cutting at a fold 22.

To have this web-severing step performed in the proper manner, a stack-opening finger 38 is present which is mounted on a shaft 39 supported on support plate 40. The latter is connected to guide rods 41 which straddle support-moving cylinder 44. Rods 41 are supported by the frame 1 such that they are movable in the vertical plane.

The rotation of the shaft 39 e.g. may take place by means of a connection to an arm 42 cooperating with a pressurized-medium cylinder such as a pneumatic or hydraulic cylinder 43, connected to the support plate 40. Vertical movement of the support plate 40 together with the rods 41 can take place by means of the pressurized medium cylinder 44, which is supportably connected to the frame 1 of the device.

Figure 2:
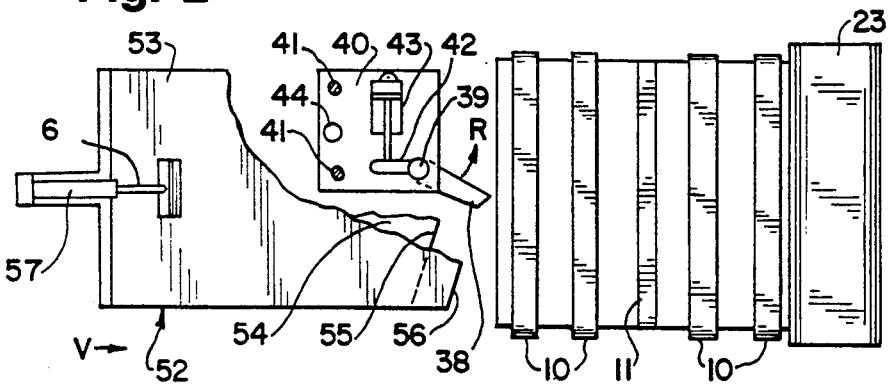
FIG. 2 schematically shows a top view of a portion of the device of FIG. 1, and FIG. 3 schematically shows an end view of the knife and flexible plates of the device of this invention, and their associated drive and guide means.

To form a unit 45 of forms consisting of a given number of sheets 20, the unit-opening finger 38 is pivoted by means of the piston and cylinder 43 in the direction of the arrow R, see FIG. 2, so that the opening finger will come to lie between two folds 21. Then by means of the pressurized medium cylinder 44 the support plate 40 is moved in the direction of the arrow S, see FIG. 1, so that the fold 21 lying immediately above it, is moved upwardly.

In this manner room is made for hold down means 46, which may consist of a number of strips 47 and which in the inactive position may be positioned beside the unit-opening finger 38. The strips 47 are connected to a plate 48 which pivots about pivot 49 and which by means of the piston and cylinder unit 50 can be pivoted to the right in FIG. 1.

After opening the pile 24 by means of the unit-opening finger 38 in the manner described above, the strips 47 are pressed downwardly onto the fold 21 present below the finger 38. Such hold-down action effects better separation of the folds 21 present below and above the finger 38. As a result, a clearly defined opening 51 in the sheet pile can be formed.

Figure 3:
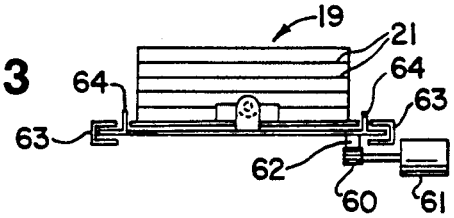

Next in the sequence of steps, assembly 52 consisting of flexible plate 53 and knife plate 54 is moved by pinion 60 rotated by motor 61 into the opening 51. Pinion 60 engages rack 62 mounted on the bottom of plate 54. Knife plate 54 is guided between opposed guides 63 seen in FIG. 3 in the course of its movement. Flexible plate 53 is guided in its movement relative to plate 54 by vertical guides 64 mounted on plate 54. Guides 63 and 64 are not illustrated in FIGS. 1 and 2 to facilitate the description of the latter figures.

Pressurized medium cylinder 57 mounted on plate 54 moves plate 53 relative to plate 54. The flexible plate 53 e.g. can be a thin plate of synthetic plastic which on the one hand may conform somewhat to the shape of the sheet 20 present immediately above the finger 38. Plate 53 may have a baffled leading edge 54, but such is not necessary. On the other hand, plate 53 can be supported at least in part by the knife plate 54 while it is simultaneously covering the plate cutting edge 55. The cutting edge 55 is positioned behind the leading edge 56 of the flexible plate 53 as seen in the direction of movement V of the assembly 52. The leading edge 56 of the flexible plate 53 and the cutting edge 55 of the knife plate 54 can be bevelled in a proven manner to facilitate movement relative to engaged sheets of the pile.

After the majority of the flexible plate 53 is moved into the formed opening or slit 51, the plate 53 is retracted with respect to the knife plate 54 by retracting piston arm 65 of cylinder 57. The end of arm 57 is mounted on plate 53, and the latter plate is moved further into the pile by pinion 60 and motor 61. To assist such movement, means including friction-reducing means can be provided between the flexible plate 53 and the knife plate 54. The knife plate cutting edge will then pass over the upper edge of wall 29 in the course of cutting a fold 22.

The knife plate 54 cuts the fold 22 which is present at the far end of the slit 51. The table 4 is then lowered by means of the motor 17 until the table upper surface 14 is located at the height of the upper surface 58 of a conveyor 59 located at one end of the table 4. Then the conveyor belts 10 of table 4 are actuated so that the form unit 45 can be brought onto the conveyor 59. Following removal of unit 45, the empty table 4 is raised by means of the motor 17 until positioned immediately below the assembly 52. During this table movement assembly 52 has served to support the supplied web of forms 19. When the table 4 is present below the assembly 52, the latter may be returned to the position shown in FIG. 1. In the meantime the unit-opening finger 38 and the hold down means 46 also be returned to their initial positions.

Also, as noted above it is possible to mount certain parts of the described apparatus on an auxiliary frame, not shown in the drawing and movable in the horizontal plane with respect of the frame 1. These certain parts comprise the wall 25, the support plate 40, the actuating cylinder 44 for the support plate 40, the pivot shaft 49 for the hold-down means 46 and the piston and cylinder unit 50 for the hold-down means 46.

By moving the auxiliary frame, e.g. towards the vertical wall 29, the device can be made suitable for handling smaller sheets 20 of the web of forms 19.

In such modified apparatus, certain parts of the table 4 can be separated so that for each size sheet provided, the upper plate 8 and associated conveyor belt 10, etc., may be accommodated to the position of the vertical wall 25.

It will be obvious to those skilled in the art that in view of the embodiment of the invention above described and shown in the drawing, that many modifications of the above-described invention not illustrated or described are encompassed within the ambit of the disclosed invention.

Thus the means for supporting and moving the unit-opening finger 38, for the hold down means 46, for the flexible plate 53 and for the knife plate 54 can be in forms other than those disclosed. Also, the removal of a unit 45 of forms from the table 4 may be effected in another way e.g., by means of a pushing member movable in horizontal direction. All these alternative constructions are believed obvious to those skilled in the art.

Also, control means will normally be present, e.g., being mounted in box 60 of frame 1, which will regulate operation of the various parts of the apparatus in the desired sequence. For supplying a desired actuating pressurized medium to the various cylinders e.g., use can be made of well-known solenoid control valves. Also, limit switches may be present near given moving parts to signal that such a part has reached its desired end position. All of these possibilities, however, will be clear to one skilled in the art.

The provided apparatus above described, by the cooperation of the flexible plate 53 and knife plate 54 enables a desired clean cut be effected with regularity. Such cuts are obtainable although the paper of the forms is thin thereby creating folds which are not exactly straight. The flexible plate prevents engagement between the knife plate and any form portion as long as the knife plate edge 55 is not positioned near the form fold to be cut or until the knife-plate stroke effecting cutting of the fold edge.

This invention is to be limited only by the scope of the appended claims and needs no further elucidation.

What is claimed is:

1. Apparatus for delivering a zigzag folded web of forms from a feed conveyor and arranging said forms into the shape of a substantially vertical stock which is severed at a given stack height for removal of a stack unit, said apparatus comprising a table adjustable in the vertical plane; means for feeding a folded web of forms onto said table; vertical confining walls disposed along at least two sides of said table for arranging a web of forms vertically into a stack on said table; at least one opening-forming finger for forming an opening in a stack disposed on said table; support means for said finger for moving said finger from a position adjacent the table to a position overlying said table and for lifting forms overlying said finger to form an enlarged opening in such stack; a flexible plate arranged substantially in the horizontal plane for movement into a stack opening formed by said finger; a knife plate positioned beneath said flexible plate and having a cutting edge rearwardly disposed of the flexible plate leading edge; said support means being adapted to move said flexible plate and knife plate into such stack until said flexible plate is disposed in a position beneath substantially one entire form; said support means stopping said flexible plate in said position and moving the knife plate beyond the support plate whereby a fold of the stacked formed is cut; means for moving said knife plate and flexible plate as a unit into a stack opening, and means mounted on said knife plate for at least partly retracting said flexible plate from a stack opening relative to said knife plate.

2. Apparatus for delivering a zigzag folded web of forms from a feeder conveyor and arranging said forms into the shape of a substantially vertical stack which is severed at a given stack height for removal of a stack unit, said apparatus comprising a table adjustable in the vertical plane; means for feeding a folded web of forms onto said table; vertical confining walls disposed along at least two sides of table for arranging a web of forms vertically into a stack on said table; at least one opening-forming finger for forming an opening in a stack disposed on said table; support means for said finger for moving said finger from a position adjacent the table to a position overlying said table and for lifting forms overlying said finger to form an enlarged opening in such stack; a flexible plate arranged substantially in the horizontal plate for movement into a stack opening formed by said finger; a knife plate positioned beneath said flexible plate and having a cutting edge rearwardly disposed at the flexible plate leading edge; said support means being adapted to move said flexible plate and knife into such stack until said flexible plate is disposed in a position beneath substantially one entire form; said support means stopping said flexible plate in said position and moving the knife plate beyond the support plate whereby a fold of the stacked forms is cut; means for moving said knife plate and flexible plate as a unit into a stack opening; means mounted on said knife plate for at least partly retracting said flexible plate from a stack opening relative to said knife plate; and means on said knife plate for guiding movement of said flexible plate relative to said knife plate; said means for moving the plates as a unit comprising a motor driven pinion engaging a rack disposed on the bottom of said knife plate.

* * * * *

UNITED STATES PATENT AND TRADEMARK OFFICE

CERTIFICATE OF CORRECTION

PATENT NO. : 5,074,835

DATED : December 24, 1991

INVENTOR(S) : Theodoris J.E. Staijen et al.

It is certified that error appears in the above-identified patent and that said Letters Patent is hereby corrected as shown below:

Title page, item, [56] European reference 0244003 change "7/1987" to -- 4/1987 --.

Title page, item, [56] German reference 8509218.5 change "9/1985" to -- 5/1985 --.

Title page, item, [56] United Kingdom reference 2196944A change "11/1988" to -- 5/1988 --.

Col. 1, line 48, after "made" insert -- of --.

Col. 5, line 23, after "of" delete "a".

Col. 6, line 16, change "54" to -- 56 --.

Col. 6, line 51, after "46" insert -- will --.

Col. 7, line 41, change "stock" to -- stack --.

Col. 8, line 12, change "formed" to -- forms --.

Col. 8, line 18, change "feeder" to -- feed --.

Col. 8, line 24, after "of" insert -- said --.

Col. 8, line 32, change "plate" to -- plane --.

Col. 8, line 35, change "at" to -- of --.

UNITED STATES PATENT AND TRADEMARK OFFICE

CERTIFICATE OF CORRECTION

PATENT NO. : 5,074,835

DATED : December 24, 1991

INVENTOR(S) : Theodoris J.E. Staijen, et al.

It is certified that error appears in the above-identified patent and that said Letters Patent is hereby corrected as shown below:

Column 8, line 37, after "knife" insert --plate--.

Signed and Sealed this

Sixth Day of July, 1993

*Attest:*

Michael K. Kirk

MICHAEL K. KIRK

*Attesting Officer*

*Acting Commissioner of Patents and Trademarks*